US009016506B1

(12) United States Patent
Borgarding

(10) Patent No.: US 9,016,506 B1
(45) Date of Patent: Apr. 28, 2015

(54) LOCKING LID ASSEMBLY FOR CONTAINERS

(71) Applicant: Curt A. Borgarding, Cincinnati, OH (US)

(72) Inventor: Curt A. Borgarding, Cincinnati, OH (US)

(73) Assignee: Lockable Solutions LLC, Cincinnati, OH (US)

( * ) Notice: Subject to any disclaimer, the term of this patent is extended or adjusted under 35 U.S.C. 154(b) by 0 days.

(21) Appl. No.: 13/844,224

(22) Filed: Mar. 15, 2013

Related U.S. Application Data

(60) Provisional application No. 61/688,125, filed on May 9, 2012.

(51) Int. Cl.
*B65D 45/00* (2006.01)

(52) U.S. Cl.
CPC ..... *B65D 45/00* (2013.01)

(58) Field of Classification Search
USPC ..... 220/315, 319, 320, 321, 324
See application file for complete search history.

(56) References Cited

U.S. PATENT DOCUMENTS

| | | | | |
|---|---|---|---|---|
| 623,380 | A | | 4/1899 | Neiman, Jr. |
| 677,046 | A | | 6/1901 | Tyden |
| 695,656 | A | | 3/1902 | Smalley |
| 781,080 | A | | 1/1905 | Lynch |
| 828,187 | A | | 8/1906 | Brunssen |
| 873,646 | A | | 12/1907 | Williams |
| 1,796,709 | A | * | 3/1931 | Halvorson ..... 24/68 CT |
| 1,817,578 | A | | 8/1931 | Perry |
| 2,081,877 | A | * | 5/1937 | Shanor ..... 220/320 |
| 2,108,024 | A | * | 2/1938 | Shanor ..... 220/320 |
| 2,522,019 | A | | 9/1950 | Cadman |
| 3,618,806 | A | | 11/1971 | Coleman |
| 3,954,252 | A | * | 5/1976 | Lyons ..... 24/270 |
| 3,974,668 | A | | 8/1976 | McWhorter |
| 4,683,728 | A | | 8/1987 | Hailey |
| 4,741,453 | A | * | 5/1988 | Stolzman ..... 220/315 |
| 4,800,627 | A | | 1/1989 | Smith |
| 4,955,501 | A | * | 9/1990 | Hodge ..... 220/315 |
| 5,167,341 | A | | 12/1992 | Morton et al. |
| 5,639,129 | A | | 6/1997 | Lindley |
| 5,997,052 | A | * | 12/1999 | Reeb et al. ..... 292/148 |
| 6,786,346 | B1 | * | 9/2004 | Gurnard et al. ..... 215/272 |
| 7,234,327 | B2 | | 6/2007 | Howes |
| 7,389,551 | B2 | | 6/2008 | Stebner |
| 7,431,555 | B2 | | 10/2008 | Liberman |
| 2011/0095040 | A1 | | 4/2011 | Onken, Jr. et al. |

* cited by examiner

*Primary Examiner* — Steven A. Reynolds
*Assistant Examiner* — Javier A Pagan
(74) *Attorney, Agent, or Firm* — Porter, Wright, Morris & Arthur LLP

(57) ABSTRACT

A locking lid assembly for use with an open top container. The lid assembly includes a lid having a upper and lower surfaces, and an outer perimeter, a retention frame swingably suspended from the bottom surface of the lid portion adjacent the outer perimeter of the lid, and a flexible tightener associated with the retention frame and configured to selectively exert a force on the retention frame, such that the force cause the retention frame to shorten in effective length and swing inwardly away from the outer perimeter of the lid.

19 Claims, 8 Drawing Sheets

LOCKING LID ASSEMBLY FOR CONTAINERS

CROSS REFERENCE TO RELATED APPLICATIONS

This application claims priority to U.S. Provisional Patent Application No. 61/688,125, filed on May 9, 2012, entitled "Lever Locking Lid." The entire disclosure of the foregoing provisional patent application is incorporated by reference herein.

BACKGROUND

With the rise in prices paid for various scrap metals such as copper and steel, theft of scrap metal has been on the rise for many years. Securing the contents of scrap metal containers such as dumpsters, roll-off containers, and the like is difficult. Some containers include flimsy lids which are easy to open, even if a locking arrangement is provided. Other containers include integrated hinged or sliding lids which rely on hinges, rollers, or other arrangements which are prone to break and can weaken the structural integrity of the container. And some state and local governments are now mandating locking, water resistant lids for scrap metal containers, as well as for various other containers used to contain waste materials.

While a variety of devices and techniques may exist for providing containers having lockable lids, it is believed that no one prior to the inventor has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings. In the drawings, like numerals represent like elements throughout the several views.

Figure 1:
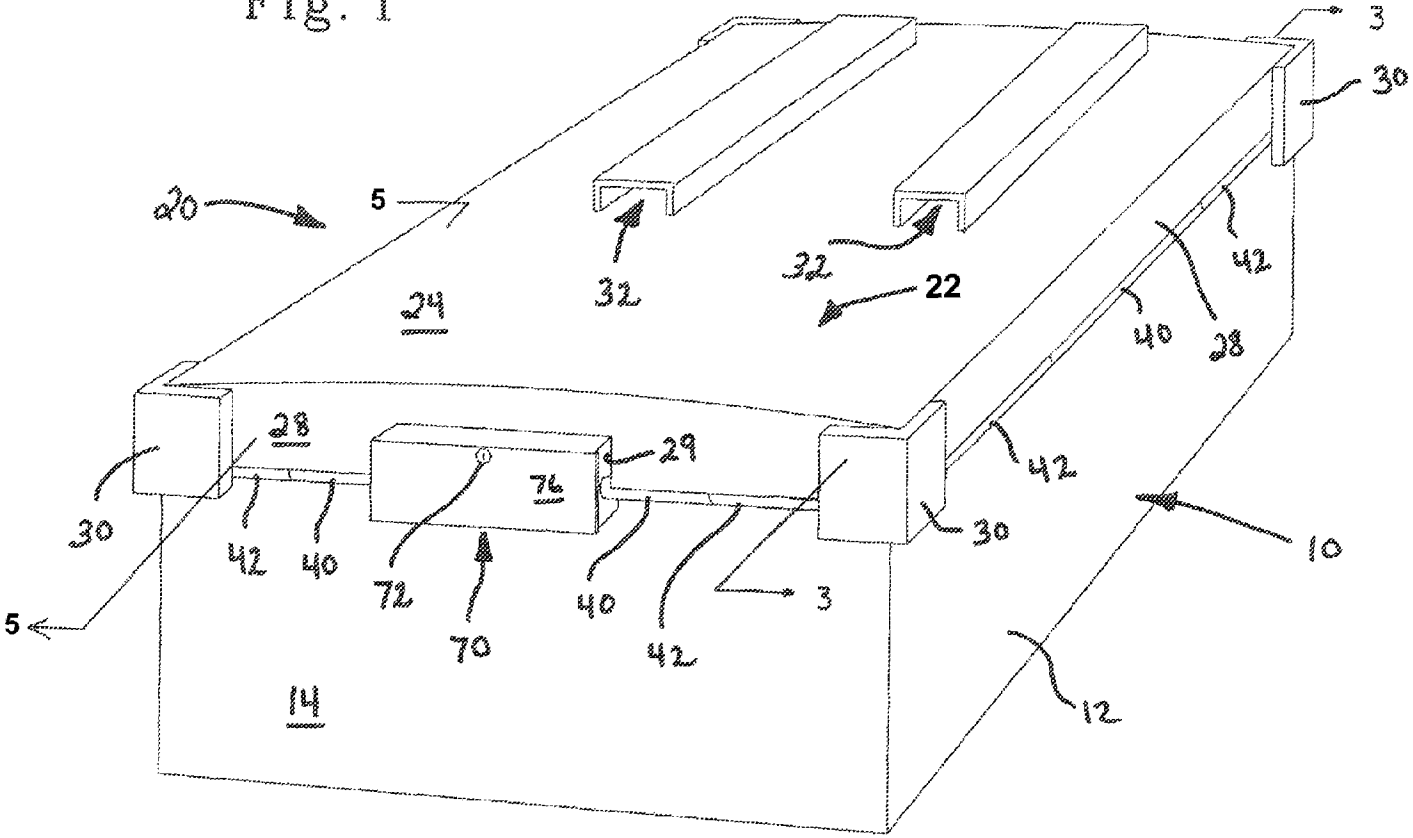
FIG. 1 depicts a perspective view of an open top container having a locking lid assembly mounted on the container, and locked in place.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples should not be used to limit the scope of the present invention. Other features, aspects, and advantages of the versions disclosed herein will become apparent to those skilled in the art from the following description. As will be realized, the versions described herein are capable of other different and obvious aspects, all without departing from the invention. Accordingly, the drawings and descriptions should be regarded as illustrative in nature and not restrictive.

The present invention is broadly directed to locking lid assemblies for various types of containers. While embodiments described below will generally be described with reference to open top waste containers such as those used to receive and contain for scrap metal for later recycling), the scope of the present invention is not so limited. Just like one man's trash is another man's treasure, these open top containers may be used to receive, contain, store and/or transport a wide variety of materials besides waste destined for recycling or disposal. For example, the locking lid assemblies described herein may be used with containers for receiving and securely storing not only scrap metal, but also various other types of waste material (solid and/or liquid), including refuse, trash, sludge, paper, food, construction debris, debris from tree trimming or clearing, demolition debris, or even manufactured goods for purposes of storage or transportation—essentially, any material typically deposited into open top containers.

In some embodiments, the locking lid assembly, like the containers with which they are intended to be used, are quite heavy—typically in excess of hundreds of requiring the use of forklifts, roll-off trucks, or other equipment in order to move or transport the container. The locking lid assemblies described herein may be used, for example, with dumpsters, trash receptacles, LFW boxes, roll-off containers, railcars, implant cars or dump hoppers. While the embodiments of containers and lid assemblies described herein are generally made from steel plate welded together, various other materials may be used instead, as well as various other fastening methods (e.g., bolts, screws, etc.). Other materials include, for example, various types of rigid plastics, various metals, carbon fiber, fiberglass, or combinations of two or more materials.

FIG. 1 is a perspective view of a container (10) having lid assembly (20) secured thereon. Container (10) has a pair of facing sidewalls (12), a pair of facing endwalls (14) and a bottom (or floor) which is hidden from view in FIG. 1. While container (10) has a generally rectangular shape, the locking lid assembly described herein may be configured to work with containers of a wide variety of shapes, such as square, various other types of polygons (regular and irregular), and even round containers (circular, elliptical, oval, etc.). For round containers, a lip may be provided at various locations about the open top of the container such as by welding adjacent pairs of angle iron segments to the exterior of the container in order to fabricate a plurality of overhanging corners on an otherwise round container such that the overhanging lips can engaged by the retention frame described further herein.

Figure 2:
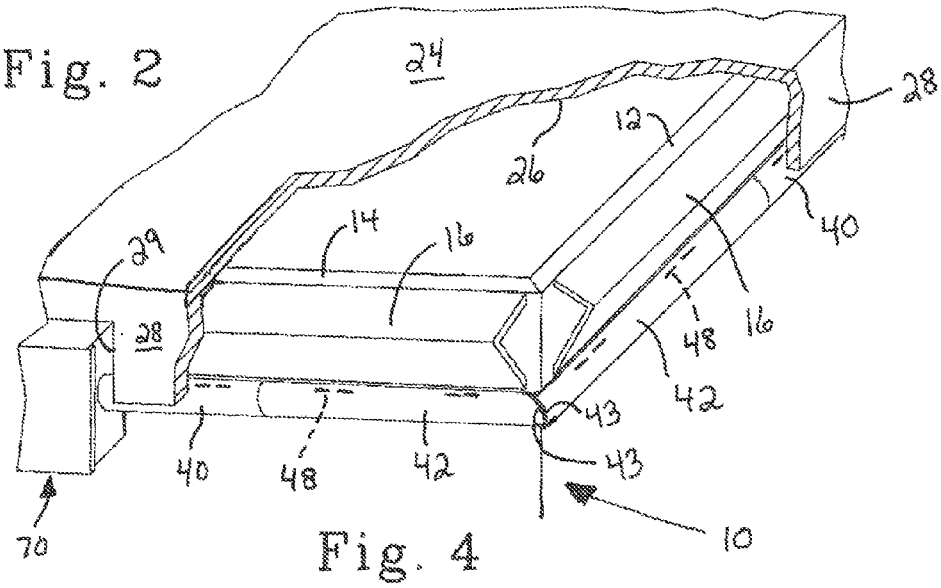
FIG. 2 depicts a partial cross-sectional view of the right lower portion of the container and lid assembly of FIG. 1, wherein the chain segments used to suspend the retention frame from the bottom surface of the lid have been omitted for purposes of clarity, with their locations shown in dashed lines.

As best seen in the partially cutaway view of FIG. 2, a lip or flange (16) extends around at least a portion of the perimeter of the container at the upper open end of the container (10). Lip (16) extends outwardly away from sidewalls (12) and endwalls (14) so as to form an overhang which extends about at least a portion of the upper perimeter of the container (10). Lip (16) is positioned at the upper open end of the container, which simply means that the lip (16) is flush with the upper end wall of the container or somewhat below the upper end wall, depending on how far the retention frame hangs from the bottom surface of the lid. In the embodiment shown in FIG. 2, lip (16) comprises segments of angle iron which have been attached to the walls (12, 14) of the container, such as by welding. If desired, the ends of the angle iron located at the corners of the container (10) may be mitered so that there is no gap between the sections of angle-iron at the corners of the container.

It will be understood that lip (16) may have any of a variety of other configurations such as that shown in FIG. 16 wherein a tubular lip (116) extends around the perimeter of container (110) at the upper open end of container (10). Lip (116) thus defines the perimeter of the upper open end of the container (110). Lip (116) may have any of a variety of other cross-sectional shapes besides the rectangular tube construction depicted in FIG. 16.

Figure 7:
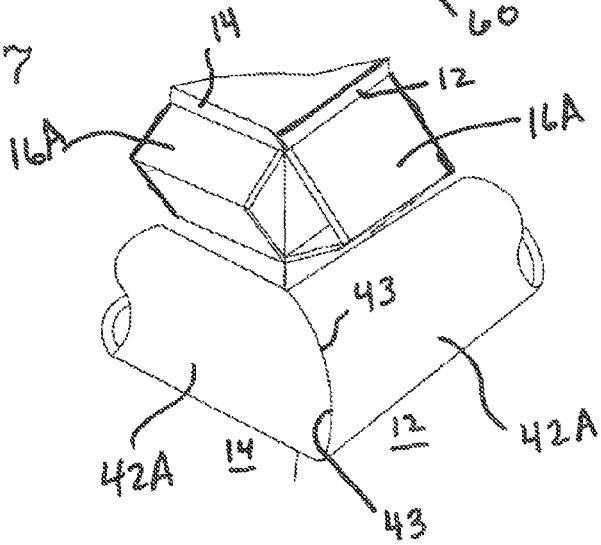
FIG. 7 is an enlarged view of the corner portion of FIG. 2.

As yet another alternative, lip or flange (16, 116) need not extend around the entire perimeter of the upper open end of the container (10, 110). Instead, lip (16, 116) may extend along the perimeter of the upper open end of the container adjacent the upper corners of the container. For example, angle iron lip (16) in FIG. 2 may extend from the corner of the container (10) along sidewall (12) less than half the length of sidewall (12), or even less than about 20% of the length of sidewall (12). Thus, lip (16, 116) may comprise a series of overhanging lips, particularly at the corners of the container. For example, FIG. 7 depicts a modified container (10) wherein a pair of lip segments (16A) are provided at the corners of the container, as shown, wherein each lip segment (16A) comprises a section of angle iron extending away from each corner of the container along a portion of the walls which intersect at that corner.

Many containers such as dumpsters, roll-off containers, and similar containers are provided with a lip (16, 116) extending about the periphery of the open top of the container in order to provide added reinforcement, rigidity and strength. Embodiments of the locking lid assembly (20, 120) are advantageous in that the lid assembly may be used with existing containers having such a lip, without the need for any modification of the container itself. For containers which do not include an overhanging lip (16, 116), particularly those lacking a lip (16, 116) which overhangs at each of the corners of the container, a lip may be attached (e.g., by welding) so that such containers may be used with the locking lid assembly. By way of example, segments of angle iron may be welded to the upper perimeter of the container, as shown in FIGS. 1 and 2 (either around the entire perimeter or at the four corners of the container).

As further described herein, retention features on locking lid assembly (20, 120), when tightened, interfere with lip (16, 116) and prevent the removal of lid assembly (20, 120) from container (10, 110). As the locking lid assembly is locked into securement on the container, the retention features of the lid assembly are pulled under lip (16, 116) and locked in position, thus preventing the removal of the lid assembly (20, 120).

Lid assembly (20) generally comprises a lid (22) having a rectangular shape generally corresponding to the shape of the open top of the container. Lid (22) may be sloped as shown, so that water (e.g. rain) will not collect on the top surface of lid (22). Lid (22) may be formed, for example, from steel plates. The lid assembly (20) further includes fork pockets (32) on upper surface (24) of lid (22) for access by a pair of forks of a forklift for purposes of lifting the lid assembly on and off of a container. Fork pockets (32) are formed, for example, by forming metal sheet (such as by bending) into a channel shape, and thereafter welding the channel shaped metal to the top surface (24) of lid (22). Various types of structural supports may also be provided for fork pockets (32), as is known to those skilled in the art. Similarly, fork pockets may also be provided on opposing walls (12, 14) of the container in order to facilitate moving the container (10) using a forklift. Likewise, various other features may similarly be provided on the container in order to facilitate lifting, moving, or other manipulation of container (10) as known to those skilled in the art. Container (10) may also be configured in various other shapes and sizes, such as in the form of roll-off container, or the various other configurations described above.

As also seen in FIGS. 1 and 2, a flange (28) extends downwardly from lid (22) about the periphery thereof. Flange (28) may be integrally formed with lid (22), such as by downwardly bending the outer periphery of steel sheet in order to form the lid (22) having downwardly extending flange (28). Alternatively, flange (28) may be welded around the periphery of a flat plated lid (22). Corner legs (30) are welded to flange (28) at the corners of the lid assembly (20). Corner legs (30) each generally comprise a right angle flange which extends below the lower edge of flange (28), as shown. Corner legs (30) serve to not only hide and protect the corners of the retention members (further described below), but also provide legs which support lid assembly (20) on a flat surface when the lid assembly is not positioned on a container. Corner legs (30) also allow multiple lid assemblies (20) to be stacked on top of each other, with the bottom ends of one lid's corner legs resting on the upper surface of the corner legs (30) of another lid assembly.

A cutout (29) is provided in flange (28), at one end thereof. Cutout (29) receives a lockbox (70) therein, as further described below. Lockbox (70) is secured within cutout (29) of flange (28), such as by welding. As further noted herein, one or more additional lockboxes (70) may be provided on the lid assembly, such as at the opposite end of the lid assembly from the lockbox shown in FIG. 1. Thus, additional cutouts (29) may be formed in flange (28) to accommodate one or more additional such lockboxes (70).

As mentioned above, the locking lid assembly (20) includes retention features which interface with the overhanging lip (16) on container (10). In the embodiment shown, these retention features comprise a plurality of retention members (40, 42) which are suspended from the bottom surface of lid (22) adjacent the outer perimeter thereof so as to provide a retention frame. As best seen in FIG. 2, retention members (40, 42) comprise a series of pipes (e.g. steel pipe) which are generally sequentially aligned with one another so as to provide an overall rectangular perimetral shape. Retention members (40, 42) together define a retention frame having a variable peripheral dimension (i.e., length).

Figure 8:
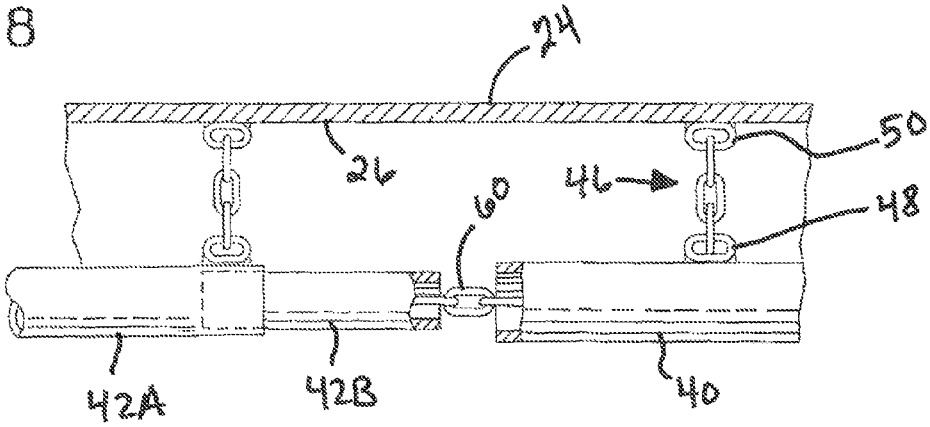
FIG. 8 is an enlarged view of the indicated portion of FIG. 3, wherein portions of the retention pipes are shown in cross-section.
Figure 9:
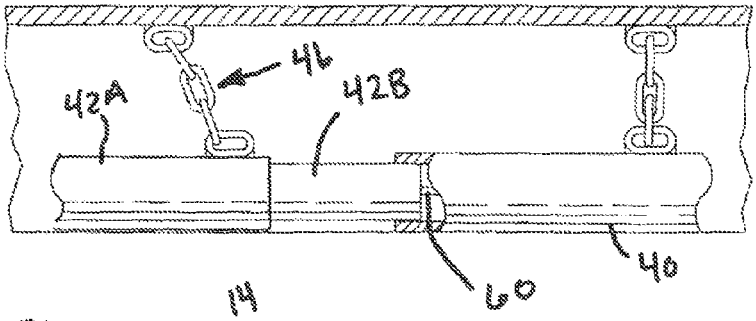
FIG. 9 is the same view as FIG. 8, wherein the retention frame has been tightened, causing the one retention pipe to telescope into an adjacent retention pipe, thereby hiding the tightening chain.

In the embodiment shown in FIGS. 1-11, three retention members/pipes (40, 42) are provided along three of the four sides of the lid (22). On the end of the lid having lockbox (70) mounted thereto, four retention members/pipes (40, 42) are provided. Retention members (40) comprise a section of pipe having a constant diameter, while retention members (42) have a varying diameter. While retention members (42) may be tapered such that the diameter of the pipe varies along its length, in the embodiment shown, retention members (42) comprise a first section (42A) having a first diameter and a second section (42B) having a second diameter which is smaller than the first diameter. As best seen in FIG. 8, a portion of second section (42B) is secured inside an end portion of first section (42A) such as by welding. In this manner, a portion of second section (42B) extends outwardly away from one end of first section (42A). The outer diameter of second section (42B) of retention pipe (42) is sized such that second section (42B) will slidably fit into the interior diameter of retention member (40), as shown in FIG. 9. The end wall of first section (42A) will also limit the penetration depth of second section (42B) into retention pipe (40), as its diameter is larger than the interior diameter of retention pipe (40) (and may be the same diameter as the outer diameter of retention pipe (40)). Thus, at least a portion of second retention member (42) is capable of telescoping into first retention member (40). It should be noted, however, that alternative embodiments of the locking lid assembly comprise a plurality of retention members (40) which do not telescope within one another. As also seen in FIGS. 2 and 7, the non-telescoping end (43) of second retention member (42) is mitered.

The retention frame comprising retention members (40, 42) may be suspended from the bottom surface (26) of lid (22) in any of a variety of ways. The retention members (40, 42) are suspended from the bottom surface (26) to allow for swinging movement of the retention members (40, 42) in a direction generally perpendicular to the longitudinal axis of the retention members (i.e., towards the interior of the container). In order to provide a variable peripheral length of the retention frame, retention members (40, 42) are also suspended from bottom surface (26) of lid (22) such that retention members (40, 42) may move in a direction parallel to their longitudinal axes (in order to vary the peripheral dimension or length of the retention frame defined by the retention pipes (40, 42)).

In the embodiment shown, retention pipes (40, 42) are suspended from the bottom surface (26) of lid (22) by a segment of metal chain (46) having one end welded to the bottom surface (26) of lid (22), and the other end of chain segment (46) welded to the outer surface of retention pipes (40, 42). As best seen in FIGS. 8 and 9, lower chain link (48) is welded to the outer surface of retention pipes (40, 42) such that the chain link is welded along its length rather than an end portion of the link. In other words, the oval-shaped opening inside the chain link extends generally parallel to the outer surface of the pipe. Upper chain link (50) of chain segment (46) is welded to bottom surface (26) of lid (22) in a similar orientation such that the oval-shaped central opening of chain link (50) is generally parallel to the plain of bottom surface (26). By orienting the top and bottom chain links in this way, additional longitudinal movement of retention pipes (40, 42) is possible.

It will be understood that the retention frame may be provided in a variety of other ways besides a series of pipes. For example, retention members (40, 42) may be replaced by an aligned series of solid, elongate members suspended from the bottom surface (26) of lid (22). Similarly, retention members (40, 42) may comprise a series of sequentially aligned pipes (i.e., aligned along their longitudinal axis) having a variety of alternative cross-sectional shapes, such as square, rectangular, elliptical or oval cross-sectional shapes.

In addition, retention members (40, 42) may be suspended from the bottom surface (26) of lid (22) using a variety of other flexible couplings. By way of example, chain segments (46) may be replaced by flexible cables, wires, straps, cords, belts or other flexible couplings or members which allow for the swinging and longitudinal movement of retention pipes (40, 42). Chain segments (46) or other flexible couplings for suspending retention pipes (40, 42), in the embodiment shown, have a length sufficient to allow the retention pipes to hang below lip (16) when the lid assembly (20) is positioned on container (10) prior to locking, but not so long that the retention pipes hang below the bottom surface of corner legs (30). In this manner, when lid assembly (20) is placed upon the ground or other flat surface and supported by corner legs (30), retention pipes (40, 42) will be held above the ground or other flat surface.

Figure 5:
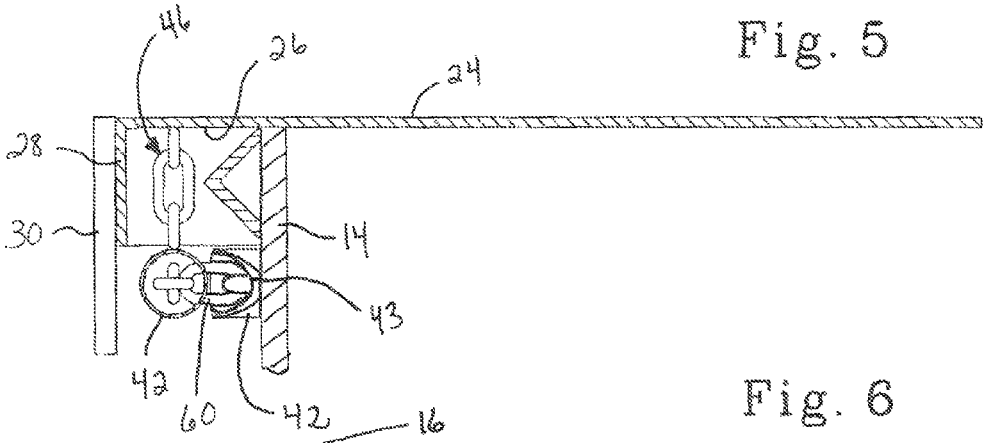
FIG. 5 is a cross-sectional view of the container and lid assembly of FIG. 1, taken along the line 5-5 thereof, wherein the retention frame is in its relaxed, untightened position, such that the retention pipes thereof are hanging straight down from the bottom surface of the lid, outward from the overhanging lip of the container.
Figure 6:
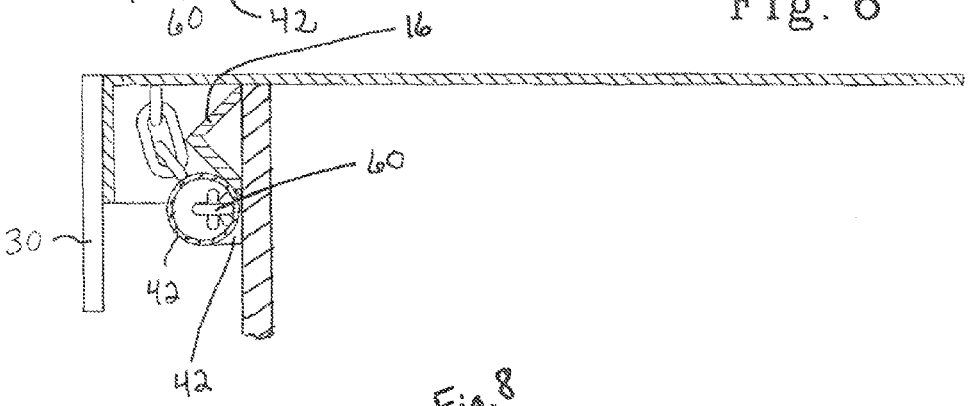
FIG. 6 is the same view as FIG. 5, wherein the retention frame has been tightened, causing the retention pipes to swing inwardly beneath the overhanging lip of the container.
Figure 3:
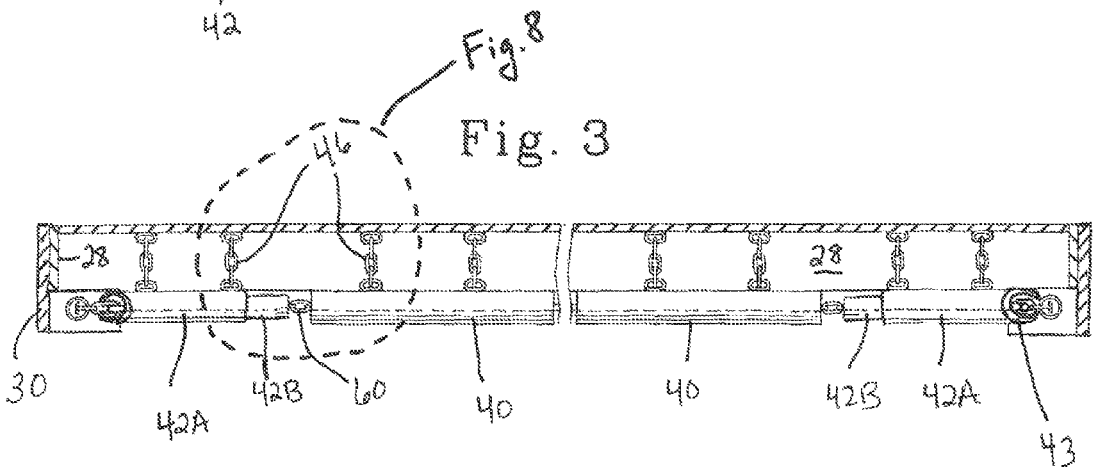
FIG. 3 is a broken, cross-sectional view of the container and lid assembly of FIG. 1, taken along the line 3-3 thereof, wherein the retention frame is in its relaxed, untightened position, such that there are gaps between the facing ends of adjacent pipes through which the chain tightener is visible

As best seen in FIGS. 5 and 6, lid assembly (20) is generally sized such that when placed on the open top of a container (10), before the retention frame is pulled tight, retention members (40, 42) are generally positioned outwardly away from lip (16) at the upper end of the container (10). In this manner, lid assembly (20) can be placed over the open top of container (10) without interference from retention pipes (40, 42). The distance by which retention pipes (40, 42) hang outwardly away from lip (16) can be varied in order to allow lid assembly (20) to be used with containers of slightly different sizes. Often these containers are used over a long period of time and in environments tending to cause damage to the containers. For example, portions of a container sidewall or corner may become dented or otherwise deformed. However, since retention pipes (40, 42) are flexibly suspended from the bottom surface of the lid, and may swing both inwardly and outwardly away from lip (16) and the walls of container (10), lid assembly (20) can accommodate various deviations in the size and shape of the container, as well as varying conditions of the container (e.g., containers that are no longer precisely square or rectangular, or otherwise have dented or damaged walls, lips, etc.).

Figure 4:
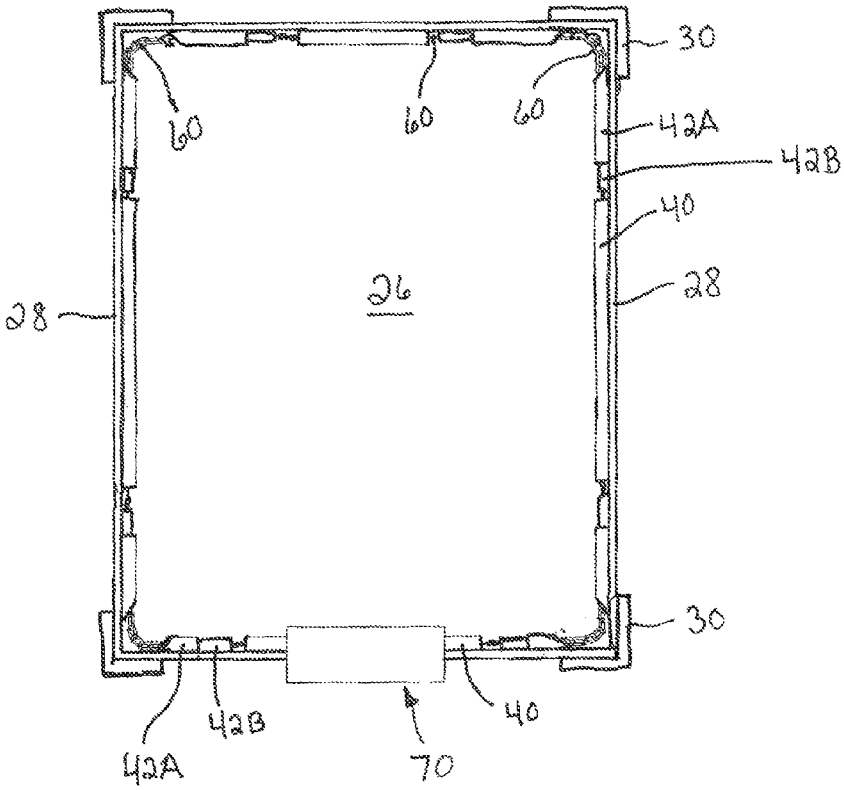
FIG. 4 is a bottom schematic plan view of the locking lid assembly of FIG. 1, wherein the retention frame is in its relaxed, untightened position, such that there are gaps between the facing ends of adjacent pipes through which the chain tightener is visible.

In order to effect not only inward swinging movement of retention pipes (40, 42) but also varying the peripheral dimension of the retention frame defined by the retention pipes, an elongate, flexible tightener is associated with the retention frame. The tightener is operable to shorten the overall effective length of the retention frame, wherein the effective length of the retention frame is the peripheral distance defined by the series of sequentially aligned retention members. For example, the peripheral distance defined by the retention frame shown in FIG. 4 is the distance extending along the longitudinal axes of the retention pipes (40, 42) (including any gaps between adjacent ends of retention pipes), from one end of lockbox (70) about the periphery of the upper end of the container to the other end of lockbox (70). When the lid is not in the locked position, this peripheral distance will be slightly greater than the outer perimetral distance of the upper end of the container at the overhanging lip (16).

As mentioned above, the elongate, flexible tightener acts on the retention members to shorten the overall effective length of the retention frame. The tightener exerts a pulling force on the retention members towards the interior of the container. Thus, in the example shown in FIG. 4, the retention pipes (40, 42) extending around the periphery of the container are pulled inwardly, causing the pipes to swing underneath lip (16) (which is not visible in FIG. 4). The elongate flexible tightener is associated with the retention members (40, 42) such that the overall effective length of the retention frame is defined by the length of the tightener associated therewith. In the embodiments shown, the elongate flexible tightener comprises a metal chain (60) with extends through the interior of the retention pipes, as shown. In this manner, simply by shortening the effective length of the chain (60) which extends through the retention pipes (40, 42), the overall effective length of the retention frame is decreased and the retention pipes will swing inwardly underneath the lip (16). The chain (60) is then locked at the shortened length such that the lid assembly (20) cannot be removed from the container (10) since the retention pipes (40, 42) are securely positioned beneath lip (16) (see FIG. 6). As seen in FIG. 6, chain (60) bears against the interior wall of the retention pipes (40, 42), and thus prevents the retention pipes (40, 42) from moving outwardly away from the outer walls (12, 14) of the container to clear the overhanging lip (16).

It should be noted that chain (60) may be operatively associated with the retention members (40, 42) in alternative arrangements besides extending through the interior of the retention members. For example, external eyelets, sleeves, pipes or other structures providing a passageway for chain (60) may be secured to the outside of retention members (40, 42) to accommodate chain (60) therein while still allowing for sliding movement of chain (60).

It should also be noted that the elongate, flexible tightener may comprise any of a variety of other structures besides a metal chain (60). For example, chain (60) can be replaced by a cable, wire, strap, cord or similar member. Combination of two more structures may also be used such as a tightener comprising a metal chain in the corner areas and a cable at others (e.g., cable segments interconnecting chain segments to provide a continuous tightener). As will be apparent, the tightener should have limited elasticity (i.e., cannot be readily stretched), and in some embodiments cannot be easily cut. Of course even the heaviest of metal chains can be cut with the right equipment (e.g., bolt cutters and the like). However, in the embodiments of lid assembly (20, 120) shown, by locating chain (60) within the interior of retention pipes (40, 42), not only is most (or even all) of chain (60) concealed when the lid assembly is locked in position, portions which are visible will be located between facing ends of adjacent retention pipes (40, 42) with very little space between the facing ends of the pipes. Because of this, it will be difficult for bolt cutters or other cutting devices to be inserted between two pipes in order to cut chain (60). In addition, the flange (28) about the periphery of lid (22) also makes it difficult to access not only chain (60) but also chain segments (46) used to suspend retention pipes (40, 42) from the bottom surface of the lid. Corner legs (30) also provide additional security in the corners, where there may be a larger gap between the facing ends of adjacent retention pipes (40, 42).

Chain (60) may be tightened (i.e., pulled taught) and locked in that tightened position in a variety of ways. In the embodiment shown in FIGS. 1-11, chain (60) is continuous in length between first and second ends (62, 64). First end (62) extends into lockbox (70) through a first aperture (80) provided on one end of lockbox (70), and second end (64) extends into lockbox (70) through a second aperture (82) provided on an opposite end of lockbox (70). Sleeves (84) may also be inserted into apertures (80, 82) to provide additional strength and longevity at the apertures (80, 82).

A pull ring (66) is provided on the first end (62) of chain (60) to facilitate tightening of chain (60). Pull ring (66) also prevents first end (62) from exiting lockbox (70) through first aperture (82), as pull ring (66) is larger than the aperture. A similar pull ring may also be provided on second end (64) of the chain, but is not shown. Of course any of a variety of other chain retainers may be provided at or adjacent the ends of chain (60) to not only facilitate manipulation of the chain but also prevent the chain ends from escaping lockbox (70).

Figure 11:
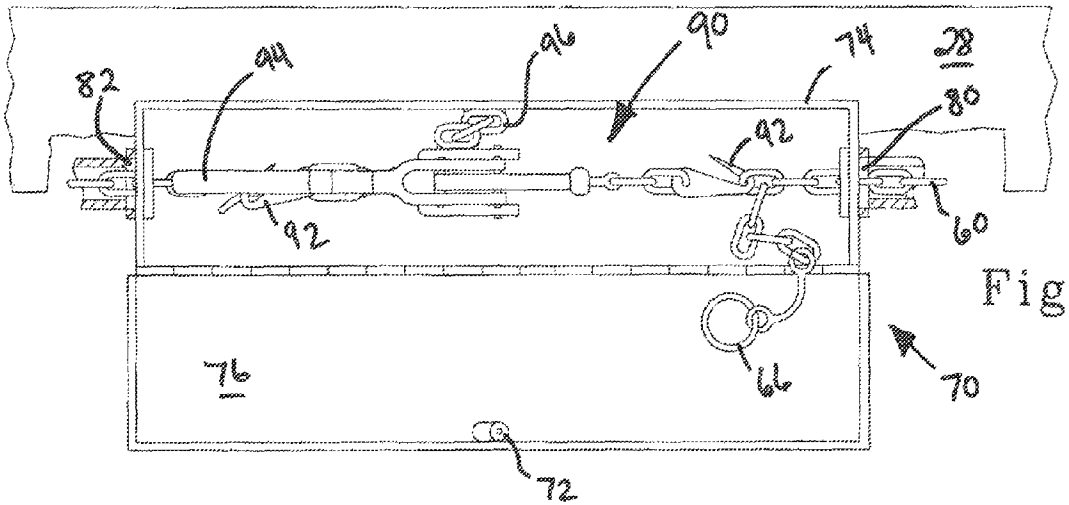
FIG. 11 depicts the lockbox, with the door open and the binder in its closed, locked position, thus having pulled more of the tightening chain into the lockbox.
Figure 10:
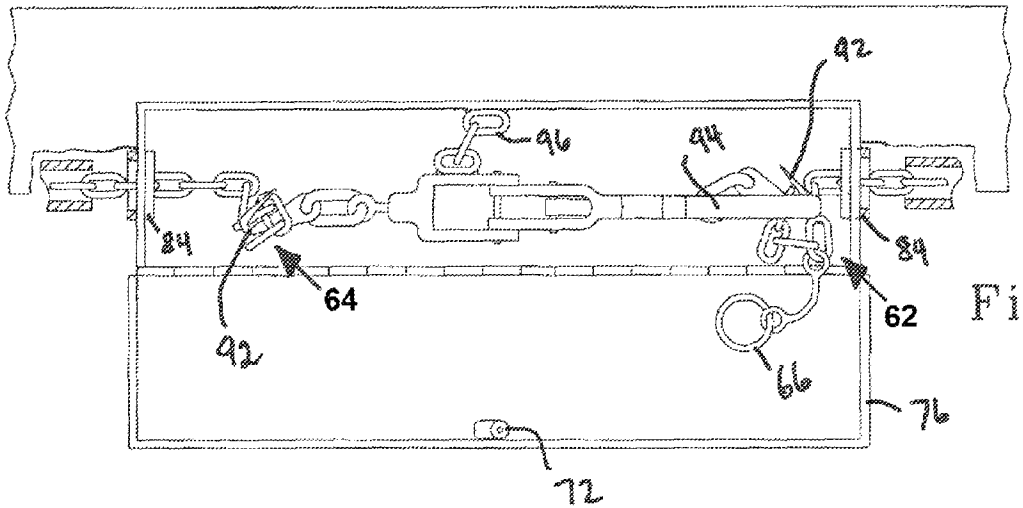
FIG. 10 depicts the lockbox, with the door open and the binder in its unlocked, open position.

In some embodiments chain (60) may be tightened (pulled taught) by hand in order to lock lid assembly (20) in place, with hooks or other features provided in lockbox (70) for maintaining chain (60) in the tightened, locked condition. However, given the size and weight of the lid assembly (20), particularly chain (60) thereof, it may be impractical to hand tighten and lock in place chain (60). Thus, the embodiment shown in includes a binder (90) for not only pulling chain (60) tight, but also locking chain (60) in a tightened condition. Binder (90), commonly referred to as a lever binder, includes grab hooks (92) at opposite ends of the binder, and a pivotally attached lever (94) which is used to pull the chain (60) tight and lock the chain in the tightened position. FIG. 10 depicts the binder in the open position, while FIG. 11 depicts binder (90) in the closed, or locked position. Binder (90) is also shown secured within lockbox (70) by chain segment (96). One end of chain segment (96) is welded to a wall of the lockbox (70) while the other end is welded to the binder (90). Of course binder (90) may be operatively secured within lockbox (70) in a variety of other ways, or even unattached to the interior of the lockbox (70). It should also be noted that one end (62, 64) of chain (60) may be permanently attached to one end of binder (90) such as by welding the end (62, 64) to one of the grab hooks (64) or other end portion of binder (90).

During use, once the lid assembly has been positioned over the open top of the container (10), second end (64) of chain (60) is secured to the second grab hook (92) of binder (90). In some instances, second end (64) may be secured to the second grab hook (92) before the lid assembly is placed on the container (permanently or non-permanently). Thereafter, the user will take out slack in chain (60) by pulling first end (62) of chain (60) further into the lockbox (70), such as by using pull ring (66). First grab hook (92) is then engaged with one of the links of chain (60), ideally the link furthest away from end (62) as the user can manage to pull into engagement with the grab hook. The lever (94) of binder (90) is then pivotally pulled away from first aperture (80) of lockbox (70) towards second aperture (82), causing more of chain (60) to be pulled into lockbox (70) through first aperture (80), as seen in FIG. 11. This causes chain (60) to be further tightened and locked in place, also causing chain (60) to pull the retention pipes (40, 42) inwardly toward the interior of the container and beneath lip (16). Binder (90) may have any of a variety of configurations known to those skilled in the art, such as that described in U.S. Pat. No. 4,800,627, the entirety of which is incorporated herein by reference. Of course various other types of binders may be used such as alternative types of load binders (ratcheted and non-ratcheted), a locking cable puller when a cable is used in place of (or in conjunction with) chain (60) (e.g., a cable come-along), and other similar devices known to those skilled in the art. Thus, the term binder is intended to encompass these various devices which are suitable for pulling the tightener (e.g., chain (60) or a cable) sufficiently tight to cause the retention members to swing inwardly, but also lock the chain or cable in its tightened position.

Lockbox (70) may have any of a variety of shapes, sizes and configurations, and that shown is merely exemplary of one possible configuration. In the embodiments shown, lockbox (70) comprises a rectangular compartment (74) fabricated from steel sheet, and includes a hingedly attached door (76). A locking mechanism (72) is also provided on door (76), and is configured for securely locking lockbox (76) once the lid assembly has been locked in position. Locking mechanism (72) may have any of a variety of configurations known to those skilled in the art, and additional features and engagements structures may be provided on or within lockbox (70), as required by the locking mechanism. By way of example, locking mechanism (72) may comprise a locking D-ring lock such as those available from Moore Industrial Hardware, Cincinnati, Ohio (e.g., a Hansen D-ring lock). The locking mechanism may even comprise a simple padlock for securing lockbox (70). While lockbox (70) is locked using a conventional key arrangement, a computerized locking mechanism may also be employed such that the lockbox is opened using a programmable access code, an RFID card device, or any of a variety of other keyless locking devices and systems.

When chain (60) is tightened by exerting a pulling force on one or both ends of the chain, not only are retention pipes (40, 42) pulled inwardly toward the interior of the box, the overall effective length of the retention frame defined by the retention pipes is shortened. This necessitates that some or all of the retention pipes will also move along their longitudinal axes. As best seen in FIGS. 8 and 9, the telescoping feature of the pipes means that a portion of the second segment (42B) of retention pipe (42) is pulled into the interior of retention pipe (40). As a result, chain (60) is no longer visible between the retention pipes (40, 42) shown in FIG. 9. And as seen in FIG. 7, the mitered ends of adjacent retention pipes (42) at the corners of the container are also pulled together, such that no portion or a minimal amount of chain (60) is exposed at the corners of the container. In addition, the ends of the retention pipes (42) adjacent the sides of lockbox (70) are also pulled tight against the sides of the lockbox such that the chain (60) is not visible (or minimally visible) here as well (see FIG. 11). Thus, by configuring at least one of the pipes along each side of the lid to be capable of telescoping (two on the side having lockbox (70)), all of the space between adjacent retention pipes (40, 42) can be removed upon tightening and binding of the chain. This also allows the use of lid assembly (20) with containers of different sizes, since the telescoping pipes allows for wider range of effective lengths for the retention frame.

Figure 12:
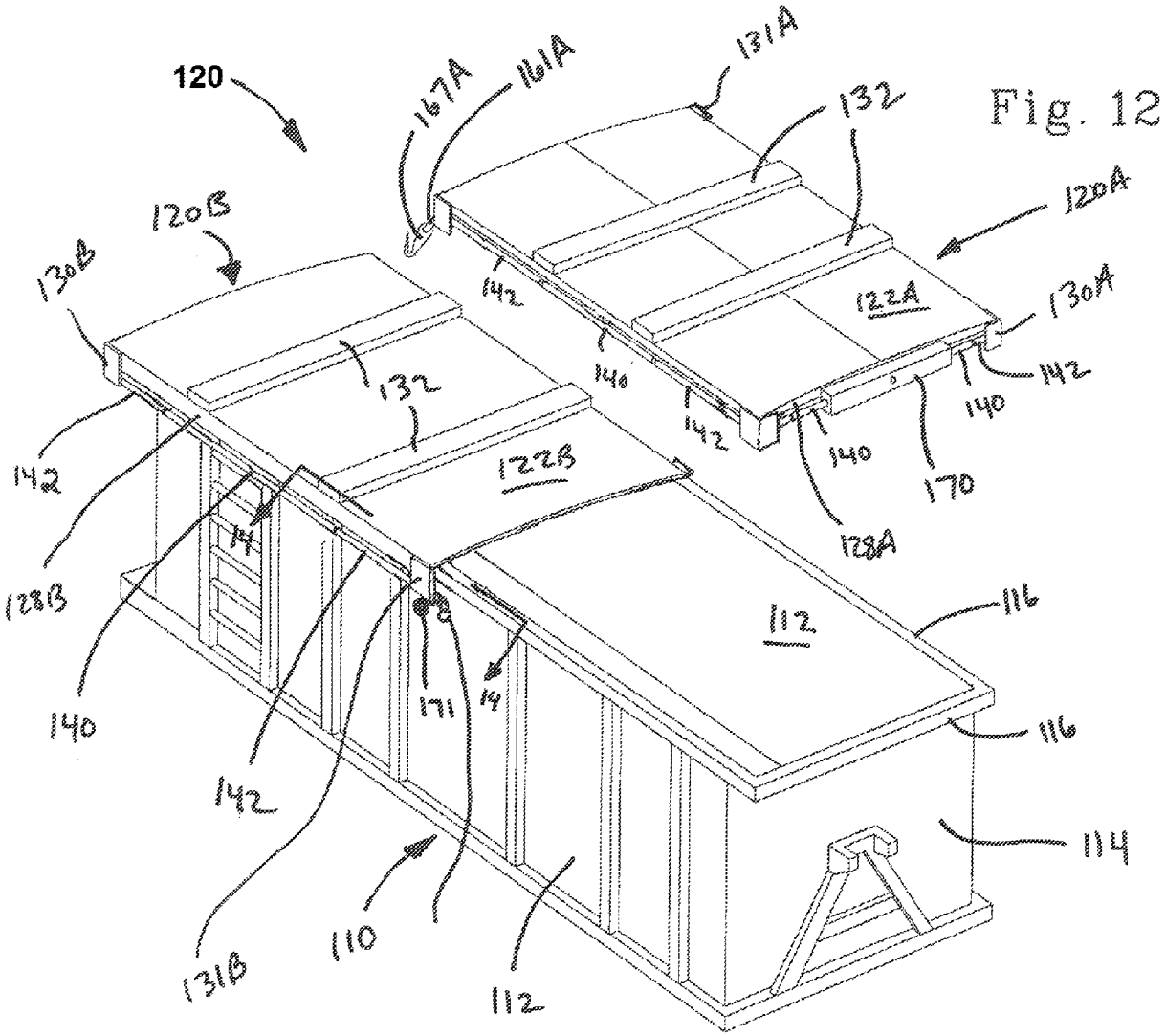
FIG. 12 is a perspective view of an alternative embodiment of a two piece locking lid assembly and a larger container, with one of the lid assembly portions removed.
Figure 14:
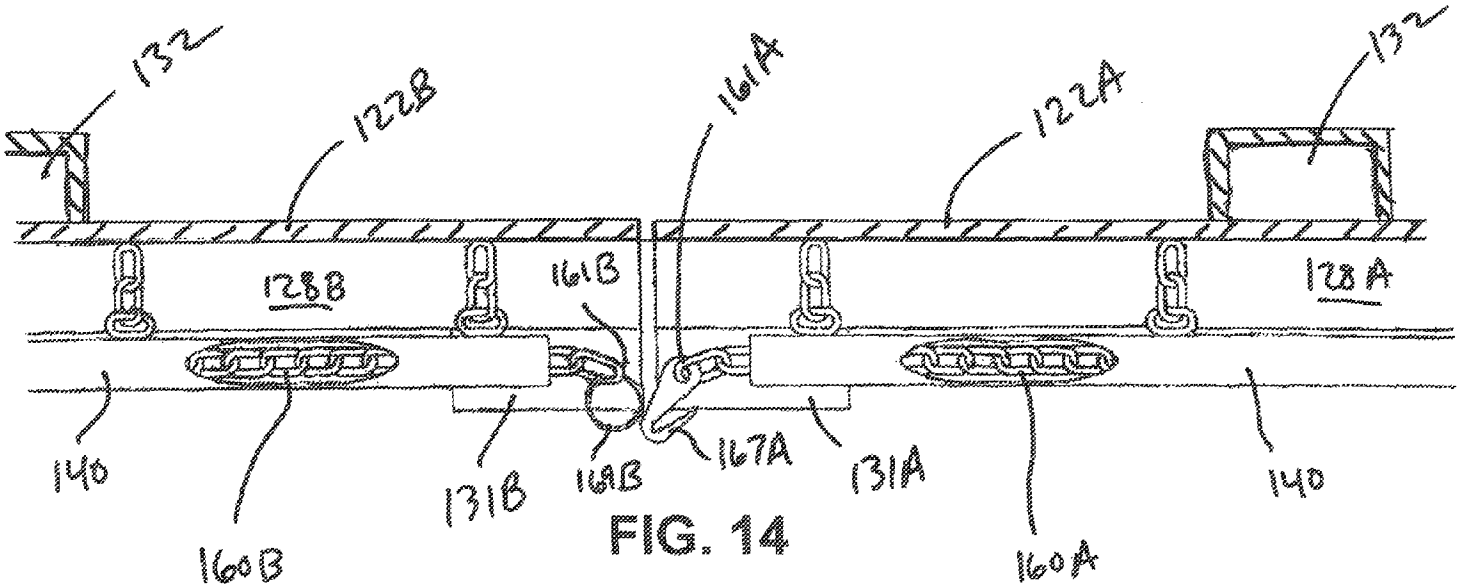
FIG. 14 is a partial cross-sectional view of the embodiment of FIG. 12, taken along the line 14-14 thereof (i.e., similar to the view shown in FIG. 3, only taken at the center of the lid and container arrangement, with both lid assembly portions positioned on the container, but in their unlocked positions).

FIG. 12 depicts an alternative embodiment of a two-piece lid assembly (120) for use on, for example, a large steel container (110), having a pair of facing sidewalls (112) and a pair of facing endwalls (114), which may be configured as a roll-off container. For larger size containers, a two-piece lid assembly can be advantageous as each lid assembly portion (120A, 120B) will be lighter in weight than a one-piece lid assembly of the same overall size. Each lid assembly portion (120A, 120B) is constructed similar to lid assembly (20) described above, including fork pockets (132) and retention members (142) comprising a first section (142A) having a first diameter and a second section (142B) having a second diameter which is smaller than the first diameter. However, unlike lid assembly (20), flange (128A, 128B) and the retention frame defined by retention pipes (140, 142) extends along only three of the four sides of the lid (122A, 122B). Flange (128A, 128B) and retention pipes (140, 142) are provided on the three sides which will extend over the lip (116) extending around the periphery of the container (110). Similarly, corner legs (130A, 130B) are only provided at the exterior corners of the lid assemblies, as shown. However, a pair of flat plate legs (131 A, 131 B) are provided at the interior corners of the lid assemblies (120A, 120B), as shown. Flat plate legs (131A, 131B) not only serve as additional legs for supporting the lid assemblies on the ground or other flat surface, they also conceal and protect the juncture of the chain sections as seen in FIG. 14.

Chain (160) is also broken such that a first chain section (160A) extends through the retention pipes of the first lid assembly portion (120A), and a second chain section (160B) extends through the retention pipes of the second lid assembly portion (120B). First chain section (160A) is also broken within lockbox (170) in the same manner as described above for chain (60).

Figure 13:
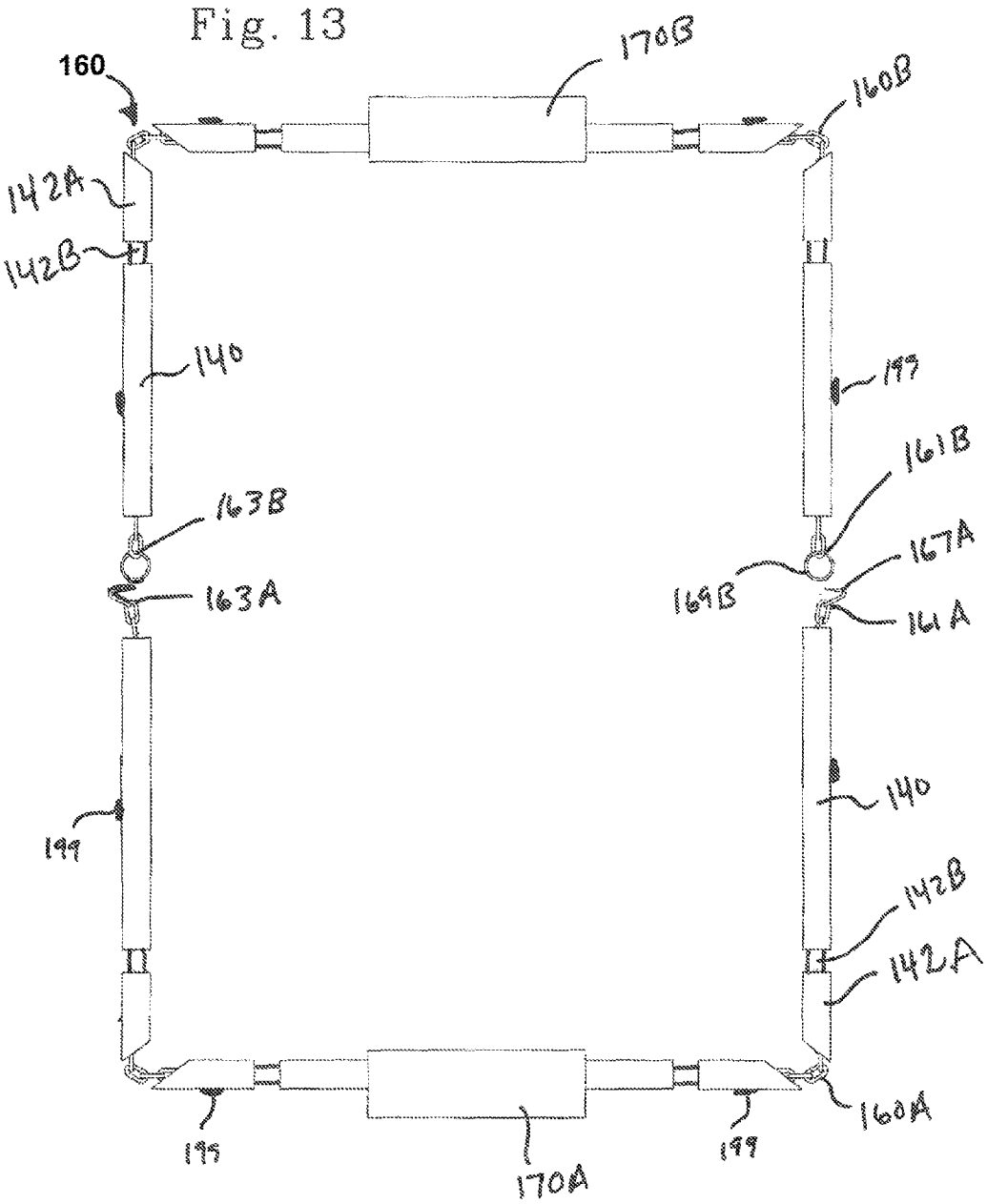
FIG. 13 is a schematic view of the retention frame and tightening chain of the lid assembly of FIG. 12, wherein a second lockbox has been added at the end of the second lid assembly portion.

The two ends of each chain section (160A, 160B) which extend outwardly from the retention pipes (142) along the sides of the lid assembly portions (120A, 120B) are configured for engagement with the corresponding end of the chain section of the other lid assembly. For example, first end (161A) of first chain section (160A) includes a grab hook (167A), and first end (161B) of second chain section (160B) includes a ring (169B) for engagement with grab hook (167A). Of course ring (169B) may be replaced by another grab hook configured for engagement with grab hook (167A) of first chain section (160A). A similar arrangement of a grab hook and ring are provided on the second ends (163A, 163B) of first and second chain sections (160A, 160B), as shown in FIG. 13. The grab hooks and rings are also sized to be larger than the interior diameter of the retention pipes such that the grab hooks and rings remain external of the retention pipes, as seen in FIG. 14. Other coupling arrangements may be used in place of the grab hooks and rings, such as carabiners on both ends of each chain section or other couplers known to those skilled in the art.

By segmenting the chain (160), one lid assembly portion (120A, 120B) may be removed from container (110) while the other remains in place (see FIG. 12). One or more chain fixation members may be provided on the exterior of container (110) for engagement with the grab hook, ring, or other feature provided on the ends of chain sections (160A, 160B). In FIG. 12, a fixation ring (171) is attached on the side of container (110) just below lip (116) at approximately the center of the container. A similar fixation ring (171) is located on the opposite sidewall of container (110). When only a single lid assembly portion (120A, 120B) is mounted on the container (110), the first and second ends of the chain section (160A, 160B) may be engaged with the fixation hooks (171).

In the case of the embodiment shown in FIG. 12, if first lid assembly portion (120A) is positioned on the container, with the chain ends engaged with the fixation hooks (171), the lid can even be locked in place using the same procedure described above with respect to lid assembly (20). And in the alternative arrangement shown in FIG. 13 wherein lockboxes (170A, 170B) each having a binder therein is provided on the ends of both lid assembly portions (120A, 120B), either lid assembly portion may be singularly locked in place on container (110).

Having such individually lockable lid assemblies may be advantageous for a variety of reasons. For example, container (110) may be positioned within an opening of a building (e.g., a door), with a portion of the container (110) located outside the building and another portion located inside the building. The door or other opening may even be sized so that the container (110) is nearly the same size as the opening (e.g., by closing a door partially over the container. The portion of container (110) extending outside of the building may have a lid assembly (120A, 120B) locked over the container, while the portion inside the building remains open (e.g., so that workers may deposit waste or other material into the container. In this manner, the exposed portion of the container has a lid locked thereon, while the container is still usable.

An additional advantage of having two lockboxes (170A, 170B) as shown in FIG. 13 is that each may be openable with a different key or access code. For example, lockbox (170A) may be configured to only be openable by personnel at the facility where the container is maintained to receive and store waste materials such as scrap metal, and the second lockbox (170B) is configured to only be openable by personnel affiliated with a scrap hauler or recycler. Even though two lockboxes (170A, 170B) are provided, it generally will be possible to remove both lid portions by opening and unbinding the chain in a single lockbox.

Figure 15:
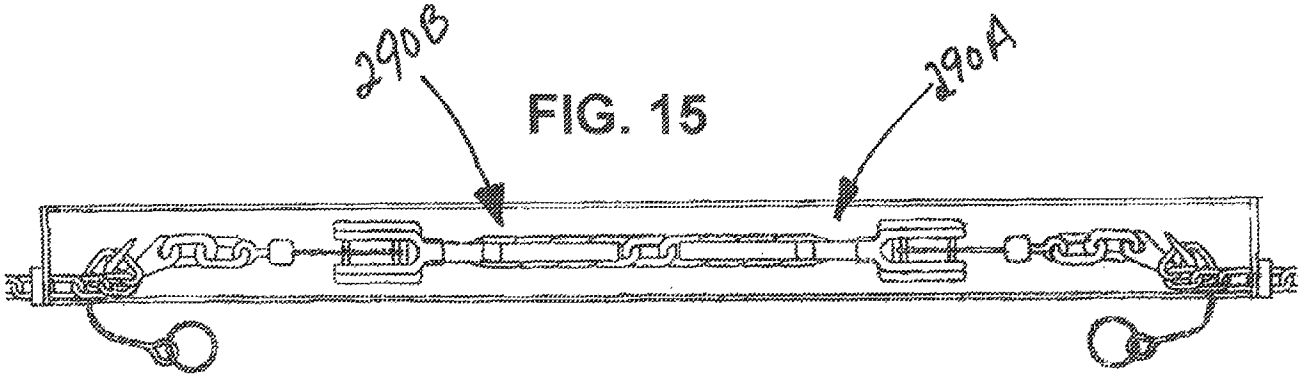
FIG. 15 depicts an alternative lockbox arrangement wherein a pair of binders are used.

In yet another alternative embodiment, lockbox (170) may have a pair of binders (290A, 290B), as shown in FIG. 15, with the two binders secured to one another as shown. On larger containers, particularly those using a two (or more) piece lid assembly, it may be difficult for a user to take out sufficient slack in the chain (160) for a single binder to securely and adequately tighten the chain due to the weight of the long chain. By providing a pair of binders (190A, 190B) within lockbox (170), however, the binders are able to pull chain (160) twice the distance as a single binder. For example, while binder (90) in FIG. 10 may have a take up of about 4" (i.e., the distance a chain is pulled by the binder), a take up of about 8" will be provided by combining two binders (190A, 190B) of the same size as binder (90).

In still further embodiments, any number of lid assembly portions may be provided. By way of example a third lid assembly portion can be provided between lid assembly portions (120A, 120B) in FIG. 12. Such a third lid assembly portion would have retention pipes and chain sections extending along the two sides of the lid, but not along the ends of the lid.

Retention members/chains (40, 42, 140, 142) are suspended from the bottom surface of the lid (22, 122A, 122B) such that when the lid assemblies are in their untightened positions, the retention members/chains will generally hang straight down. In other to provide greater clearance, magnets (e.g., neodymium magnets) may be provided on the outer surface of one or more of the retention pipes and/or on an inner surface of the flange (28, 128A, 128B) such that the magnetic force will pull the retention pipes outwardly towards the inner wall of the flange (28, 128A, 128B) thereby maintaining the retention pipes against the inner wall of the flange until the chain is tightened. When the pipes and flange comprise steel or other ferrous metal, magnets may only be needed on one of the pipes and flanges. As seen in FIG. 13, magnets (199) are attached to the outer surface of various ones of the retention pipes (140, 142), so as to be in facing relation to flange (128A, 128B). Such an arrangement will facilitate mounting the lid assembly on a container, as well as prevent the chains from swinging and banging against the container or flange (28, 128A, 128B) during installation and removal. Of course other types of structures may be used for a similar purpose such as springs, hooks, etc.

While several devices and components thereof have been discussed in detail above, it should be understood that the components, features, configurations, and methods of using the devices discussed are not limited to the contexts provided above. In particular, components, features, configurations, and methods of use described in the context of one of the devices may be incorporated into any of the other devices. Furthermore, not limited to the further description provided below, additional and alternative suitable components, features, configurations, and methods of using the devices, as well as various ways in which the teachings herein may be combined and interchanged, will be apparent to those of ordinary skill in the art in view of the teachings herein.

Having shown and described various versions in the present disclosure, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A locking lid assembly for an open top container, said assembly comprising:

(a) a lid having upper and lower surfaces, and an outer perimeter;

(b) a retention frame swingably suspended from the lower surface of the lid portion adjacent the outer perimeter of the lid, said retention frame having a variable effective length wherein said retention frame comprises a plurality sequentially aligned retention members; and (c) a flexible tightener associated with the retention frame and configured to selectively exert a force on the retention frame, such that the force causes the retention frame to shorten in effective length and swing inwardly away from the outer perimeter of the lid.

2. The locking lid assembly of claim 1, wherein said retention members comprise elongate pipes.

3. The locking lid assembly of claim 1, wherein said retention members comprise hollow, elongate members, and said flexible tightener comprises a chain or cable extending through the interior of said elongate members.

4. The locking lid assembly of claim 3, further comprising a lockbox located along a side of said lid between two of said elongate members, said lockbox having apertures on opposing walls of the lockbox, said apertures adapted for receiving a portion of said chain or cable therethrough such that said chain or cable extends through each of said apertures into the lockbox.

5. The locking lid assembly of claim 4, further comprising a binder in said lockbox for linking the chain or cable portions which extend into the lockbox and lockably tightening the chain or cable.

6. The locking lid assembly of claim 5, wherein said elongate members comprise elongate pipes, wherein at least one of said pipes is configured to telescope into an adjacent pipe when the chain or cable exerts a pulling force on the pipes.

7. An open top container in combination with a locking lid assembly mounted thereon, comprising a container having a lip which extends outwardly away from the outer walls of the container at the open top thereof around at least a portion of the perimeter of the open top, and the locking lid assembly of claim 1.

8. The open top container and locking lid assembly of claim 7, wherein said lid assembly is located on said open top container such that the retention frame of the lid assembly is positioned external to the outer walls of the container below said lip.

9. The locking lid assembly of claim 1, wherein said flexible tightener has a variable effective length and said retention members comprise hollow, elongate members, with the flexible tightener extending through the interior of said elongate members, and further wherein at least one of said elongate members is configured to telescope into an adjacent elongate member when the effective length of the flexible tightener extending through the elongate members is shortened.

10. The locking lid assembly of claim 1, wherein said lid comprises a plurality of lid portions having upper and lower surfaces, with a portion of said retention frame suspended from the lower surface of each of said lid portions, said plurality of lid portions adapted for end-to-end alignment on an open top container.

11. The locking lid assembly of claim 10, wherein said retention members comprise hollow, elongate members and said flexible tightener comprises a plurality of chain sections, each of which extends through the elongate members suspended from the lower surface of one of said lid portions, each of said chain sections configured for coupling engagement with another chain section.

12. The locking lid assembly of claim 1, further comprising a pair of fork pockets on said lid assembly, said fork pockets arranged and adapted to enable the lid assembly to be lifted using a forklift.

13. The locking lid assembly of claim 1, further comprising a flange which extends downwardly from at least a portion of the outer periphery of said lid, said flange configured to at least partially conceal said retention frame.

14. The locking lid assembly of claim 13, further comprising a binder for lockably tightening said tightener.

15. A method of securing the locking lid assembly of claim 1 on an open top container having an overhanging lip adjacent to at least a portion of the upper open end of the container, comprising the steps of:

(a) positioning the lid assembly on the open top of the container such that the retention frame of the lid assembly is positioned external to the outer walls of the container below said lip;

(b) shortening the effective length of said tightener such that the retention frame swings inwardly towards the outer walls of the container and beneath said lip; and (c) securing the tightener at the shortened effective length such that the lid assembly is secured to the container by the retention frame interfacing with the overhanging lip of the container.

16. A lid assembly for an open top container having an overhanging lip adjacent to at least a portion of the upper open end of the container, said lid assembly comprising:

(a) a lid having upper and lower surfaces, and an outer perimeter;

(b) a retention frame for interfacing with the overhanging lip of a container, said retention frame comprising a series of hollow, elongate members swingably suspended from the lower surface of the lid adjacent the outer perimeter of the lid;

(c) a tightener having a variable effective length and extending through the interior of said elongate members, said tightener adapted to effect inward swinging movement of said retention frame relative to the outer perimeter of the lid; and (d) a binder for shortening the effective length of said tightener so as to effect inward swinging movement of the retention frame for securing the lid assembly on the open top of a container.

17. The locking lid assembly of claim 16, further comprising a lockbox for securably retaining said binder therein, the lockbox located along one side of said lid, said lockbox having first and second ends, wherein said retention frame is swingably suspended from the lower surface of said lid between the first and second ends of the lockbox, and further wherein a portion of said tightener extends into said lockbox.

18. The locking lid assembly of claim 16, wherein said lid comprises a plurality of lid portions having upper and lower surfaces, with a portion of said retention frame suspended from the lower surface of each of said lid portions.

19. A lid assembly for an open top container, said lid assembly comprising:

(a) a lid having upper and lower surfaces, and an outer perimeter; and (b) a retention frame comprising a plurality of sequentially aligned, elongate pipes swingably suspended from the bottom surface of the lid adjacent the outer perimeter of the lid, said pipes adapted to receive a tightening chain therethrough for effecting inward swinging movement of said elongate pipes relative to the outer perimeter of the lid, wherein at least one of said elongate pipes is configured to telescope into an adjacent elongate pipe.

* * * * *

UNITED STATES PATENT AND TRADEMARK OFFICE

CERTIFICATE OF CORRECTION

PATENT NO. : 9,016,506 B1
APPLICATION NO. : 13/844224
DATED : April 28, 2015
INVENTOR(S) : Curt A. Borgarding It is certified that error appears in the above-identified patent and that said Letters Patent is hereby corrected as shown below:

In the Claims,

Column 14, line 48, change “bottom” to --lower--.

Signed and Sealed this
Eighteenth Day of August, 2015

Michelle K. Lee

Michelle K. Lee
*Director of the United States Patent and Trademark Office*